US006732806B2

(12) United States Patent
Mauldin et al.

(10) Patent No.: US 6,732,806 B2
(45) Date of Patent: May 11, 2004

(54) ONE TRIP EXPANSION METHOD AND APPARATUS FOR USE IN A WELLBORE

(75) Inventors: Doran B. Mauldin, Slide, LA (US); Larry D. Sibley, Slidell, LA (US)

(73) Assignee: Weatherford/Lamb, Inc., Houston, TX (US)

( * ) Notice: Subject to any disclaimer, the term of this patent is extended or adjusted under 35 U.S.C. 154(b) by 34 days.

(21) Appl. No.: 10/060,029

(22) Filed: Jan. 29, 2002

(65) Prior Publication Data

US 2003/0141059 A1 Jul. 31, 2003

(51) Int. Cl.[7] ..... E21B 43/10; E21B 23/00

(52) U.S. Cl. ..... 166/382; 166/277; 166/227; 166/207; 166/205; 166/206

(58) Field of Search ..... 166/205, 206, 166/207, 227, 229, 233, 277, 382

(56) References Cited

U.S. PATENT DOCUMENTS

| | | | | |
|---|---|---|---|---|
| 988,504 | A | * | 3/1911 | Wiet |
| 1,233,888 | A | * | 7/1917 | Leonard |

(List continued on next page.)

FOREIGN PATENT DOCUMENTS

| | | | | |
|---|---|---|---|---|
| DE | 3213464 | A1 | 10/1983 | ..... B23D/45/12 |
| DE | 4133802 | C1 | 10/1992 | ..... F16L/9/12 |
| EP | 0952305 | | 4/1998 | ..... E21B/43/10 |
| GB | 730338 | | 3/1954 | ..... 84/4 |
| GB | 792886 | | 4/1956 | |
| GB | 997721 | | 7/1965 | |
| GB | 1277461 | | 6/1972 | ..... B21D/39/04 |
| GB | 1448304 | | 9/1976 | ..... E21B/33/13 |
| GB | 1457843 | | 12/1976 | ..... B21D/39/10 |
| GB | 1582392 | | 1/1981 | ..... B21D/39/10 |
| GB | 2216926 | A | 10/1989 | ..... E21B/7/20 |
| GB | 2313860 | | 6/1996 | ..... E21B/10/34 |
| GB | WO9717526 | A * | 5/1997 | ..... E21B/43/10 |
| GB | 2329918 | A | 4/1999 | ..... E21B/43/10 |
| GB | 2 370 301 | | 6/2002 | ..... E21B/43/08 |
| WO | WO 92/01139 | | 1/1992 | ..... E21B/17/08 |
| WO | WO 93/24728 | | 12/1993 | ..... E21B/17/10 |
| WO | WO 93/25800 | | 12/1993 | ..... E21B/43/10 |
| WO | WO 94/25655 | | 11/1994 | ..... D04C/1/06 |
| WO | WO 97/17527 | | 5/1997 | ..... E21B/43/10 |
| WO | WO 97/21901 | | 6/1997 | ..... E21B/17/08 |
| WO | WO 98/00626 | | 1/1998 | ..... E21B/43/10 |
| WO | WO 99/02818 | | 1/1999 | ..... E21B/43/10 |
| WO | WO 99/18328 | | 4/1999 | ..... E21B/23/01 |
| WO | WO 99/23354 | | 5/1999 | ..... E21B/43/10 |
| WO | WO 01/98623 | | 12/2001 | ..... E21B/19/16 |
| WO | WO 02/090712 | | 11/2002 | ..... E21B/43/10 |

OTHER PUBLICATIONS

Gilmer, J. M., Emerson, A. B., World's First Completion Set Inside Expandable Screen, Baker Hughes Incorporated, Feb. 11–13, 2003.*

(List continued on next page.)

*Primary Examiner*—David Bagnell
*Assistant Examiner*—Thomas S Bomar
(74) *Attorney, Agent, or Firm*—Moser, Patterson & Sheridan, L.L.P.

(57) ABSTRACT

The present invention includes a method and apparatus for setting a liner in a wellbore and then expanding a screen in the wellbore in a single trip. In one aspect of the invention, a liner and expandable screen is provided with a slip assembly to fix the liner in the wellbore. An expansion tool and work sting is run into the wellbore in the liner. After the liner is set, the expansion tool is used to expand the screen. In another embodiment, an annular area between the expansion tool and work string is utilized in order to set the slips. Thereafter, cup packers used in forming the annulus are lifted from the liner prior to expanding the screen.

12 Claims, 15 Drawing Sheets

U.S. PATENT DOCUMENTS 1,301,285 A * 4/1919 Leonard
1,880,218 A * 10/1932 Simmons
1,981,525 A * 11/1934 Price ..... 166/4
2,017,451 A * 10/1935 Wickersham ..... 166/10
2,214,226 A * 9/1940 English ..... 166/1
2,216,226 A * 10/1940 Bumpous ..... 36/44
2,383,214 A * 8/1945 Prout et al. ..... 153/82
2,424,878 A * 7/1947 Crook ..... 154/82
2,499,630 A * 3/1950 Clark ..... 153/81
2,519,116 A * 8/1950 Crake ..... 166/10
2,627,891 A * 2/1953 Clark ..... 153/82
2,633,374 A * 3/1953 Boice ..... 285/118
3,028,915 A * 4/1962 Jennings ..... 166/16
3,039,530 A * 6/1962 Condra ..... 166/55
3,167,122 A * 1/1965 Lang ..... 166/14
3,179,168 A * 4/1965 Vincent ..... 166/14
3,186,485 A * 6/1965 Owen ..... 166/63
3,191,677 A * 6/1965 Kinley ..... 166/14
3,191,680 A * 6/1965 Vincent ..... 166/46
3,203,451 A * 8/1965 Vincent ..... 138/143
3,203,483 A 8/1965 Vincent ..... 166/207
3,245,471 A 4/1966 Howard ..... 166/46
3,297,092 A 1/1967 Jennings ..... 166/207
3,326,293 A 6/1967 Skipper ..... 166/150
3,353,599 A 11/1967 Swift ..... 166/15
3,354,955 A 11/1967 Berry ..... 166/14
3,358,760 A 12/1967 Blagg ..... 166/14
3,477,506 A 11/1969 Malone ..... 166/207
3,489,220 A 1/1970 Kinley ..... 166/277
3,583,200 A 6/1971 Cvijanovic et al. ..... 72/393
3,669,190 A 6/1972 Sizer et al. ..... 166/315
3,689,113 A 9/1972 Blaschke ..... 285/90
3,691,624 A 9/1972 Kinley ..... 29/523
3,712,376 A 1/1973 Owen et al. ..... 166/277
3,746,091 A 7/1973 Owen et al. ..... 166/207
3,776,307 A 12/1973 Young ..... 166/125
3,780,562 A 12/1973 Kinley ..... 72/479
3,785,193 A 1/1974 Kinley et al. ..... 72/393
3,820,370 A 6/1974 Duffy ..... 72/75
3,948,321 A 4/1976 Owen et al. ..... 166/277
3,977,076 A 8/1976 Vieira et al. ..... 30/103
4,319,393 A 3/1982 Pogonowski ..... 29/434
4,349,050 A 9/1982 Bergstrom et al. ..... 138/147
4,359,889 A 11/1982 Kelly ..... 72/62
4,362,324 A 12/1982 Kelly ..... 285/119
4,382,379 A 5/1983 Kelly ..... 73/46
4,387,502 A 6/1983 Dom ..... 29/568
4,407,150 A 10/1983 Kelly ..... 72/61
4,414,739 A 11/1983 Kelly ..... 29/727
4,445,201 A 4/1984 Pricer ..... 365/154
4,450,612 A 5/1984 Kelly ..... 72/62
4,470,280 A 9/1984 Kelly ..... 72/61
4,483,399 A 11/1984 Colgate ..... 166/308
4,487,630 A 12/1984 Crook et al. ..... 75/123 B
4,502,308 A 3/1985 Kelly ..... 72/58
4,505,142 A 3/1985 Kelly ..... 72/54
4,505,612 A 3/1985 Shelley, Jr. ..... 405/101
4,567,631 A 2/1986 Kelly ..... 29/157.3
4,581,617 A 4/1986 Yoshimoto et al. ..... 346/108
4,626,129 A 12/1986 Kothmann et al. ..... 405/43
4,807,704 A 2/1989 Hsu et al. ..... 166/313
4,866,966 A 9/1989 Hagan ..... 72/75
4,883,121 A 11/1989 Zwart ..... 166/217
4,976,322 A 12/1990 Abdrakhmanov et al. .... 175/57
4,997,320 A 3/1991 Hwang ..... 408/22
5,014,779 A 5/1991 Meling et al. ..... 166/55.7
5,031,699 A 7/1991 Artynov et al. ..... 166/285
5,048,611 A * 9/1991 Cochran ..... 166/374
5,052,483 A 10/1991 Hudson ..... 166/55
5,052,849 A 10/1991 Zwart ..... 403/300
5,156,209 A 10/1992 McHardy ..... 166/324
5,267,613 A 12/1993 Zwart et al. ..... 166/178
5,271,472 A 12/1993 Leturno ..... 175/107
5,301,760 A 4/1994 Graham ..... 175/61
5,307,879 A 5/1994 Kent ..... 166/382
5,322,127 A 6/1994 McNair et al. ..... 166/313
5,348,095 A 9/1994 Worrall et al. ..... 166/380
5,366,012 A 11/1994 Lohbeck ..... 166/277
5,409,059 A 4/1995 McHardy ..... 166/208
5,472,057 A 12/1995 Winfree ..... 175/57
5,520,255 A 5/1996 Barr et al. ..... 175/24
5,553,679 A 9/1996 Thorp ..... 175/73
5,560,426 A 10/1996 Trahan et al. ..... 166/120
5,636,661 A 6/1997 Moyes ..... 137/614.2
5,667,011 A 9/1997 Gill et al. ..... 166/295
5,706,905 A 1/1998 Barr ..... 175/61
5,785,120 A 7/1998 Smalley et al. ..... 166/55
5,887,668 A 3/1999 Haugen et al. ..... 175/79
5,901,789 A 5/1999 Donnelly et al. ..... 166/381
5,924,745 A 7/1999 Campbell ..... 285/90
5,960,895 A 10/1999 Chevallier et al. ..... 175/27
5,979,571 A 11/1999 Scott et al. ..... 175/61
5,984,568 A 11/1999 Lohbeck ..... 403/375
6,012,522 A 1/2000 Donnelly et al. ..... 166/276
6,012,523 A 1/2000 Campbell et al. ..... 166/277
6,029,748 A 2/2000 Forsyth et al. ..... 166/380
6,050,341 A 4/2000 Metcalf ..... 166/383
6,070,671 A 6/2000 Cumming et al. ..... 166/381
6,085,838 A 7/2000 Vercaemer et al. ..... 166/277
6,112,818 A 9/2000 Campbell ..... 166/384
6,273,634 B1 8/2001 Lohbeck ..... 403/297
6,454,013 B1 * 9/2002 Metcalfe ..... 166/382

OTHER PUBLICATIONS

Stepkowski, A., Chapman, K., First 5–½" Expandable Sand Screen Installation & Axial Compliant Expansion in a Deepwater Oil Producer Well Offshore Brazil, Weatherford Completion Systems, Nov. 14, 2002.*
PCT International Search Report, International Application No. PCT/GB 03/00288, dated Jul. 9, 2003.
USSN 09/848,900, filed May 5, 2000.
USSN 09/554,677, filed Nov. 19, 1998.
USSN 09/530,301, filed Nov. 2, 1998.
USSN 09/470,176, filed Dec. 22, 1999.
USSN 09/470,154, filed Dec. 22, 1999.
USSN 09/469,692, filed Dec. 22, 1999.
USSN 09/469,681, filed Dec. 22, 1999.
USSN 09/469,643, filed Dec. 22, 1999..
USSN 09/469,526, filed Dec. 22, 1999.
USSN 09/462,654, filed Jul. 13, 1998.
USSN 09/469,690, filed Dec. 22, 1999.
Metcalfe, P.—"Expandable Slotted Tubes Offer Well Design Benefits", *Petroleum Engineer International,* vol. 69, No. 10 (Oct. 1996), pp. 60–63—XP000684479.

* cited by examiner

ONE TRIP EXPANSION METHOD AND APPARATUS FOR USE IN A WELLBORE

BACKGROUND OF THE INVENTION

1. Field of the Invention

The present invention relates to an apparatus and method using expandable tubulars to complete a well. More particularly, the invention relates to the installation of an expandable sand screen. More particularly still, the invention relates to a single trip installation process to set a liner hanger in a wellbore and then expand a sand screen.

2. Description of the Related Art

Hydrocarbon wells are typically formed with a central wellbore that is supported by steel casing. The casing lines a borehole formed in the earth during the drilling process. An annular area formed between the casing and the borehole is filled with cement to further support and form the wellbore.

Some wells are produced by perforating the casing of the wellbore at selected depths where hydrocarbons are found. Hydrocarbons migrate from the formation through the perforations and into the wellbore where they are usually collected in a separate string of production tubing for transportation to the surface of the well. In other instances, a lower portion of a wellbore is left open and not lined with casing. This "open hole" completion permits hydrocarbons in an adjacent formation to migrate directly into the wellbore where they are subsequently raised to the surface, possibly through an artificial lift system.

Open hole completions can provide higher production than cased hole completions and they are frequently utilized in connection with horizontally drilled boreholes. However, open hole completions leave aggregate material, including sand, free to invade the wellbore. Sand entering an open hole wellbore causes instability within the open hole which enhances the risk of complete collapse. Sand production can also result in premature failure of artificial lift and other downhole and surface equipment due to the abrasive nature of sand. In some instances, high velocity sand particles can contact and erode lining and tubing.

Sand can also be a problem where casing is perforated to collect hydrocarbons. Typically, casing is perforated with a perforating assembly or "guns" that are run into a wellbore and fired to form the perforations. Thereafter, the assembly is removed and a separate assembly is installed to collect the migrating hydrocarbons. The perforations also create a passageway for aggregate material, including sand to enter the wellbore. As with an open wellbore, sand entering the cased wellbore can interfere with the operation of downhole tools, clog screens and damage components, especially if the material enters the wellbore at a high velocity.

To control particle flow into a wellbore, well screens are often employed downhole. Conventional wellscreens are placed adjacent perforations or unlined portions of the wellbore to filter out particulates as production fluid enters a tubing string. One form of well screen recently developed is the expandable sand screen (ESS). In general, the ESS is constructed of different composite layers, including a filter media.

A more particular description of an ESS is found in U.S. Pat. No. 5,901,789, which is incorporated by reference herein in its entirety. That patent describes an ESS which consists of a perforated base pipe, a woven filtering material, and a protective, perforated outer shroud. Both the base pipe and the outer shroud are expandable, and the woven filter is typically arranged over the base pipe in sheets that partially cover one another and slide across one another as the sand screen is expanded. The ESS is expanded by a cone-shaped object urged along its inner bore or by an expander tool having radially outward extending rollers that are fluid powered from a tubular string. Using expansion means like these, the ESS is subjected to outwardly radial forces that urge the expanding walls against the open formation or parent casing. The components of the ESS are expanded past their elastic limit, thereby increasing the inner and outer diameter of the tubular.

A major advantage to the ESS in an open wellbore is that once expanded, the walls of the wellbore are supported by the ESS. Additionally, the annular area between the screen and the wellbore is mostly eliminated, and with it the need for a gravel pack. A gravel pack is used with conventional well screens to fill an annular area between the screen and wellbore and to support the walls of the open hole. With an ESS, the screen is expanded to a point where its outer wall places a stress on the walls of the wellbore, thereby providing support to the walls of the wellbore to prevent dislocation of particles. Solid expandable tubulars are oftentimes used in conjunction with an ESS to provide a zonal isolation capability. In addition to open wellbores, the ESS is effectually used with a perforated casing to control the introduction of particulate matter into the cased wellbore via the perforations.

While an ESS can reduce or eliminate the inflow of particles into a wellbore, the screen must be installed and expanded in order to operate effectively. Any delay in the installation permits additional time for sand to enter the wellbore and the time period is especially critical between the formation of perforations in a casing wall and the expansion of screen against the perforations. The delays are especially critical if the newly formed wellbore is placed in an over balanced condition prior to expanding the ESS. An overbalanced condition permits fluids to enter the formations and hamper later production of hydrocarbons.

In current installation procedures of ESS the operator makes two trips downhole. In the first trip, the operator sets a liner hanger to secure the ESS in the wellbore. After returning from the first trip downhole, the operator must make a second trip with an expansion tool in order to expand the ESS.

There are several disadvantages to a multiple trip installation procedure. The biggest disadvantage relates to expensive downtime necessary to make both trips. Also, a delay between the first and second trips can cause well control problems due to fluid loss. For example, pressurized fluid in the wellbore used to actuate various mechanical components during the installation process can enter the formations causing formations to clog-up or collapse, restricting the flow of hydrocarbons. In addition, loss of drilling fluid increases the completion cost of the well. In other instances, a delay between perforating a casing and expanding a sand screen against the perforations increases the likelihood that solids from the formations will enter the wellbore. In addition to the foregoing, packers used to fix an ESS in a wellbore often have a relatively small inside diameter. These packer-like components remain in the wellbore and can cause access problems for remedial work required below the suspension device.

There is a need therefore, for an apparatus to reduce the time needed to install an expandable sand screen in a wellbore. There is a further need to set a sand screen in a wellbore and then expand the sand screen in a single trip. There is a further need for a method and apparatus to facilitate the setting of a liner hanger in a wellbore prior to the expansion of an ESS. Still further, there is a need for an apparatus to minimize the exposure to formation solids before expanding the ESS. There is a further need for a single trip ESS apparatus that uses a liner hanger that does not restrict access within the wellbore after the ESS is expanded.

SUMMARY OF THE INVENTION

The present invention includes a method and apparatus for installing and expanding an ESS in a wellbore in a single trip. In one aspect of the invention, a liner hanger and expandable screen are provided and are run into the wellbore with an expansion tool and work string. After the hanger is set, the expansion tool is used to expand the screen. In another aspect, an annular area within the apparatus is utilized in order to set the hanger with pressurized fluid. Thereafter, cup packers used in sealing the annulus are lifted from the liner prior to expanding the screen. The expansion tool and work string are then removed leaving the expanded ESS and hanger in the wellbore.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention provides a method and apparatus to install an ESS in a wellbore and to expand the screen in a single trip. The invention includes a hanger which is used to set the screen in a wellbore before the screen is expanded by an expansion tool in the same trip into the wellbore.

Figure 1:
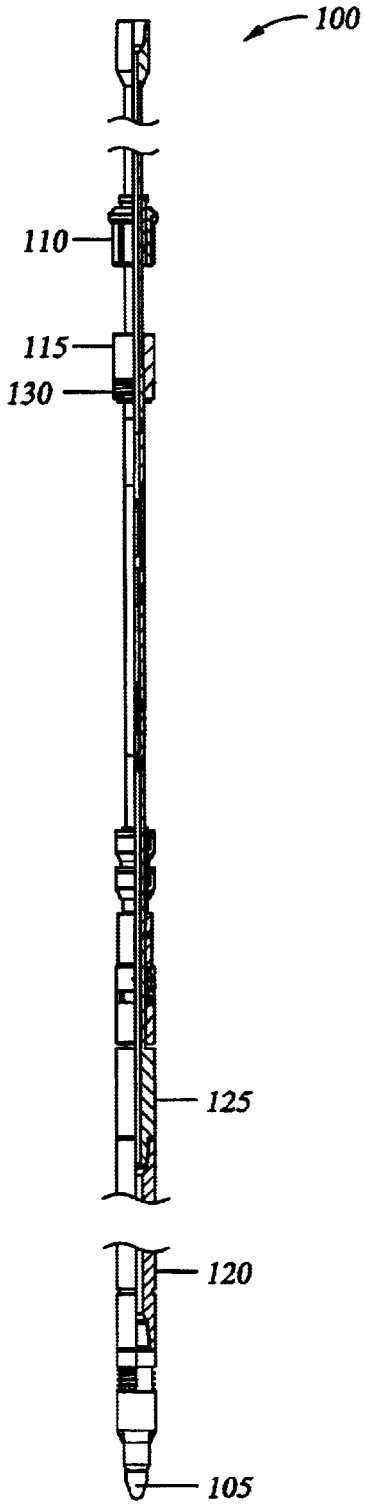
FIG. 1 is a partial cross section view of an expansion tool assembly.
Figure 2:
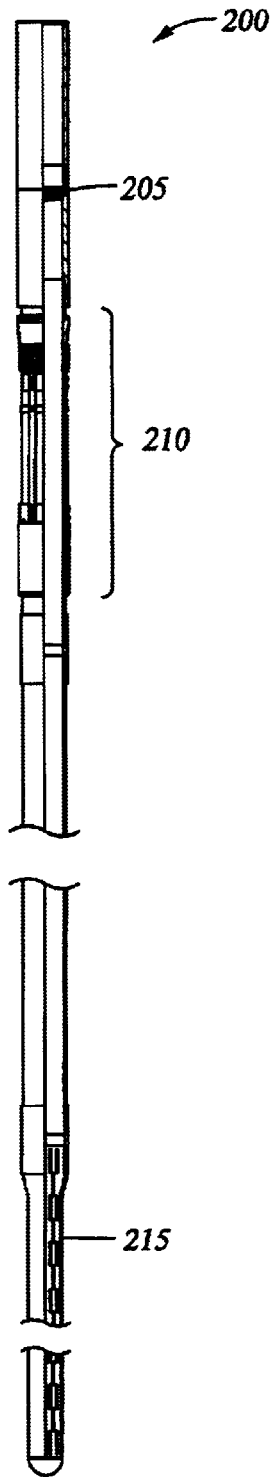
FIG. 2 is a partial cross section view of a liner and sand screen assembly.

FIG. 1 illustrates a partial cross section view of an expansion tool assembly 100 and FIG. 2 illustrates a partial cross section view of a liner and sand screen assembly 200. While a portion of liner or non slotted tubular is shown in FIG. 1, it will be understood that the invention can be used with a section of liner above an expandable sand screen or with only a section of expandable sand screen. Further, while the Figures illustrate the invention in use with an open, noncased wellbore, it will be further understood that the methods and apparatus disclosed are equally usable in a cased wellbore with perforations formed therein. FIGS. 1 and 2 show the tool assembly 100 and the liner assembly 200 separated to illustrate the major components of each assembly. In use, the expansion tool assembly 100 is housed within assembly 200. FIGS. 3 to 14 will fully describe the interface between the tool assembly 100 and the liner assembly 200. In FIG. 1, the expansion tool assembly 100 includes a dust cover 110 at the upper end to seal the end of assembly 200 and to prevent wellbore contaminates from entering the liner. The assembly 100 further includes a carry nut 115 with male threads 130 that mates with female threads 205 near the top of the liner assembly 200 to secure the tool assembly 100 in the liner assembly 200.

A carrying tool 125 is located at the lower portion of the assembly 100 to facilitate removal of the tool assembly 100 from the liner assembly 200 after expanding a screen 215. A mud motor 120 is located adjacent to a rotary expander tool 105 at the lower end of the tool assembly 100. In operation, fluid is pumped from the surface of the well down a bore of the tool assembly 100 and into the mud motor 120. The mud motor 120 uses the fluid to rotate the rotary expander tool 105, thereby expanding the screen 215 disposed at the lower end of the liner assembly 200. A hydraulic liner hanger assembly 210 is located at the upper portion of the liner assembly 200 to secure the assembly 200 in a wellbore.

Figure 3A:
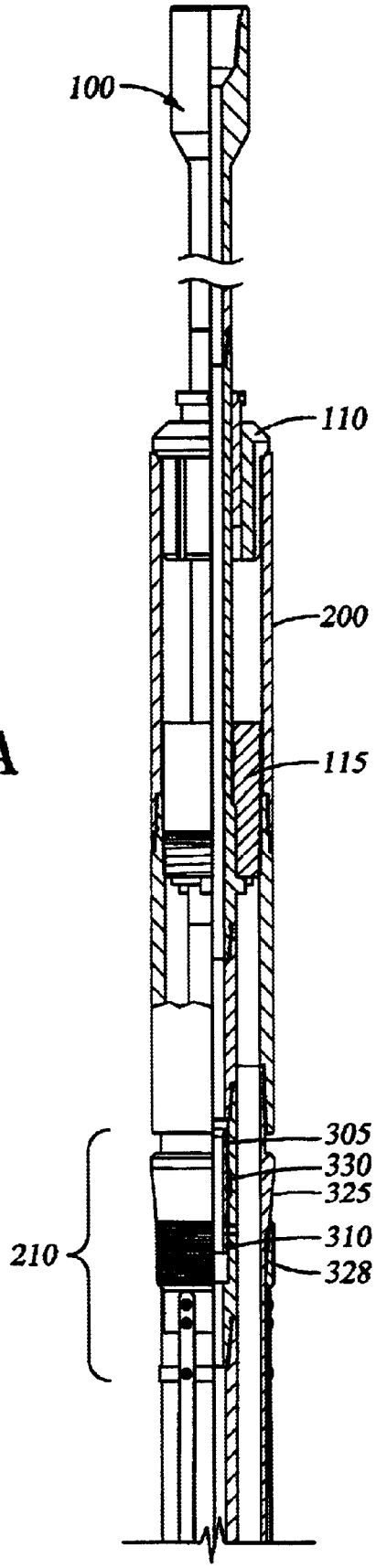
FIG. 3A illustrates an upper portion of the expansion tool assembly and liner assembly.

FIG. 3A illustrates the upper section of the expansion tool assembly 100 and the liner assembly 200. The dust cover 110 sits on top of the liner assembly 200. The carry nut 115 is shown threaded into the liner assembly 200. An upper ball seat and sleeve 305 is located below the carry nut 115 and is secured to the tool assembly 100 by a first shear pin 310. A first circumferential groove 330 is used in a later step to reestablish a fluid passageway in the bore of the assembly 100. The liner hanger assembly 210 includes a plurality of cones 325 and slips 328 disposed about the circumference of the liner assembly 200. The slips 328 include a tapered surface that mates with a corresponding tapered surface on the cone 325. During the setting of the liner assembly 200 in the wellbore, the cones 325 are used to displace the slips 328 radially outward as an axial force is applied to the slip 328 in direction of the cones 325.

Figure 3B:
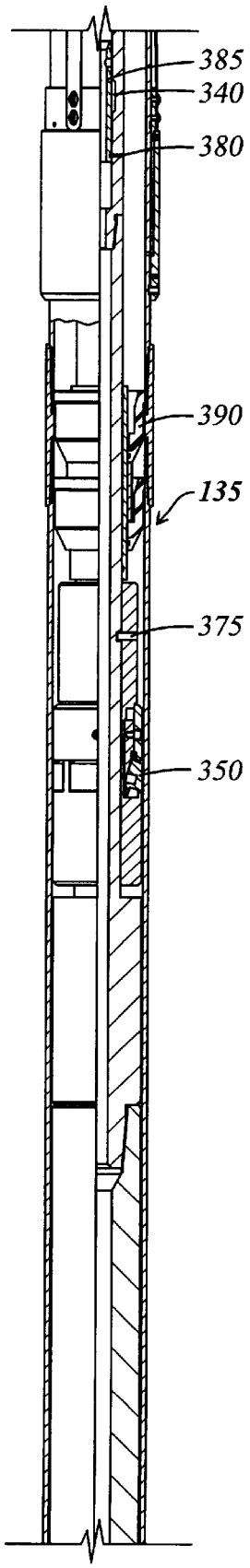
FIG. 3B illustrates a middle portion of the expansion tool assembly and liner assembly.
Figure 3C:
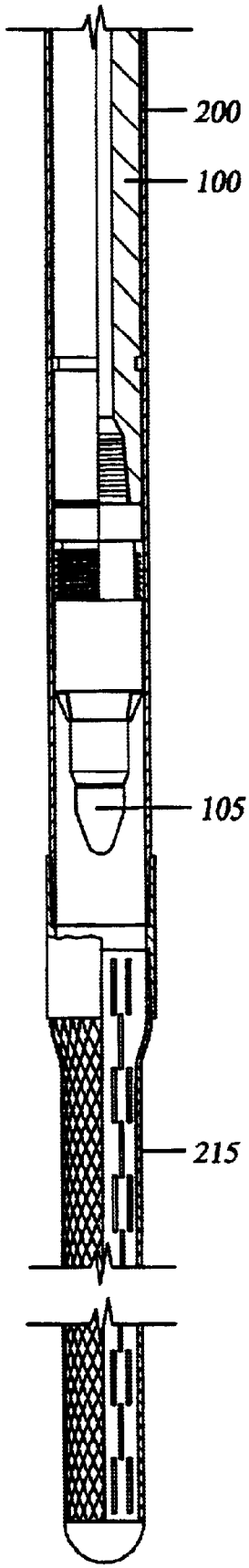
FIG. 3C illustrates a lower portion of the expansion tool assembly and liner assembly.

FIG. 3B illustrates a middle section of the expansion tool assembly 100 and the liner assembly 200. A lower ball seat and sleeve 385 is located below the slips 328 (not shown) and is secured in the tool assembly 100 by a second pin 380. Below the lower ball seat and sleeve 385 is a second circumferential groove 340 which is used in a later step to reestablish a fluid passageway down the bore of the assembly 100. A plurality of swab cups 390 used to seal an annular area between the tool assembly 100 and the liner assembly 200 are located below the second shear pin 380. Expandable dogs 350, shown in the retracted position, are located below the swab cups 390. The dogs 350 are used to hold a portion of the tool assembly 100 above the top surface of the liner assembly 200 as will be described herein. A third shear pin 375 is located between the swab cups 390 and the dogs 350 to temporarily hold the dogs 350 and cups 390 around the work string 135. FIG. 3C illustrates a lower portion of the tool assembly 100 and the liner assembly 200. As shown, the expander tool 105 on the tool assembly 100 is housed at an upper end of the expandable sand screen 215. The screen 215 includes a funnel shaped opening to facilitate entry into the screen 215 by the expander tool 105.

Figure 4:
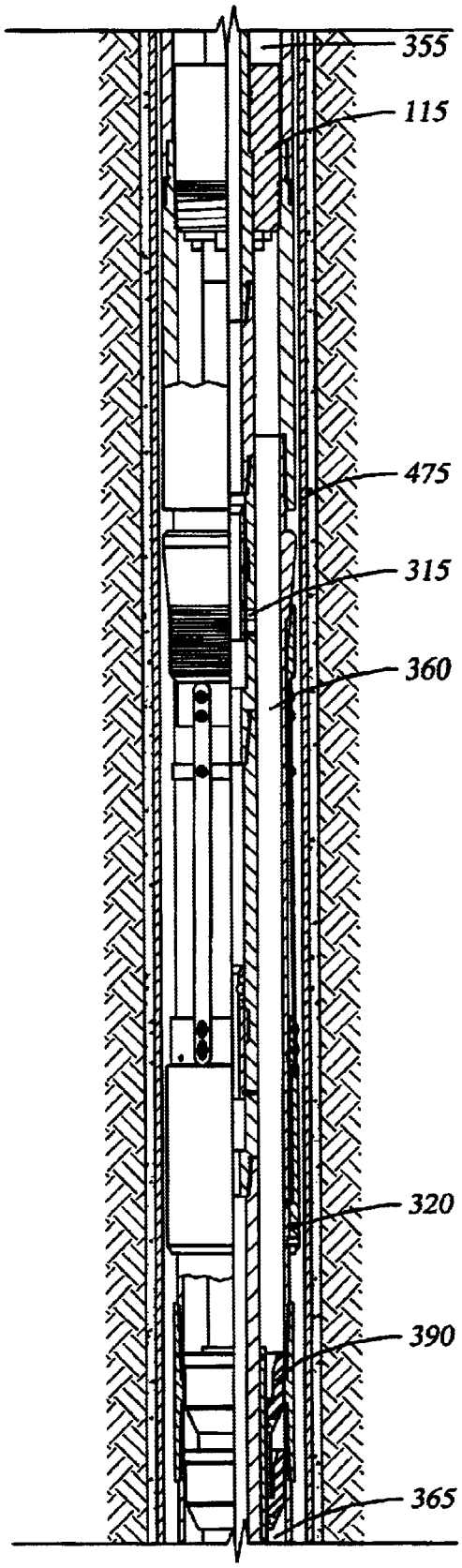
FIG. 4 illustrates an annular area formed between the expansion tool assembly and liner assembly.

FIG. 4 illustrates an annular area formed between the expansion tool assembly 100 and liner assembly 200. The annulus is created upon insertion of the tool assembly 100 into the liner assembly 200. The annulus is separated into an upper annulus 355, a middle annulus 360 and a lower annulus 365. The carry nut 115 separates the upper annulus 355 from the middle annulus 360. The swab cups 390 separate the middle annulus 360 from the lower annulus 365. The middle annulus 360 serves as a fluid pathway between a first port 315 and a second port 320 which is later used to set the slips 328 that fix the liner 200 in the wellbore.

Figure 5:
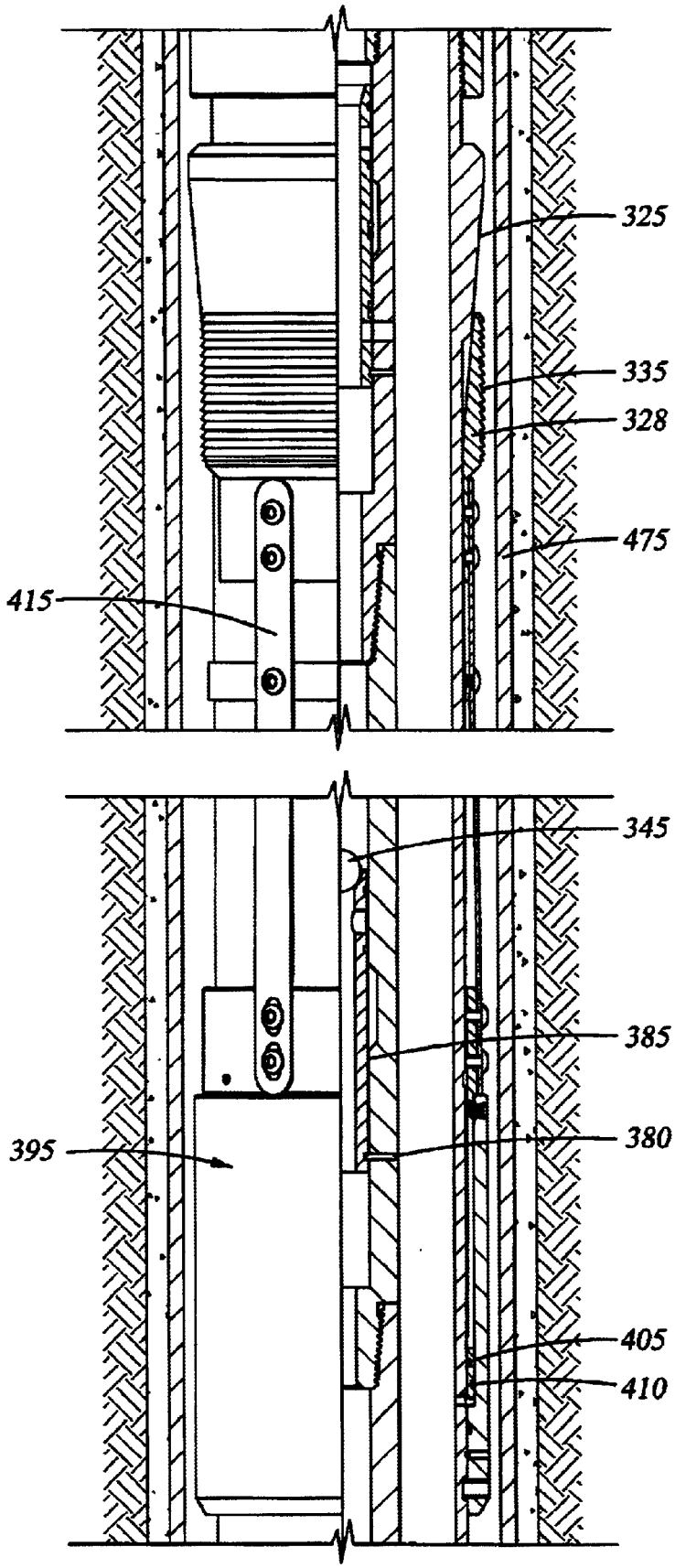
FIG. 5 illustrates the expansion tool assembly and liner assembly after a first ball has been dropped into a lower ball seat and sleeve.

FIG. 5 illustrates the expansion tool assembly 100 and liner assembly 200 after a first ball 345 has been dropped into a lower ball seat and sleeve 385. The view further illustrates, the liner assembly 200 prior to setting the slips 328. As shown, there is no contact between the teeth 335 on the slips 328 and a casing 475. At a later point the tapered portion of the slips 328 will be urged up cones 325 by a plurality of longitudinal members 415 that are connected to an annular piston 395. The piston 395 has a top O-ring 405 and a bottom O-ring 410 for creating a fluid tight seal.

Figure 6:
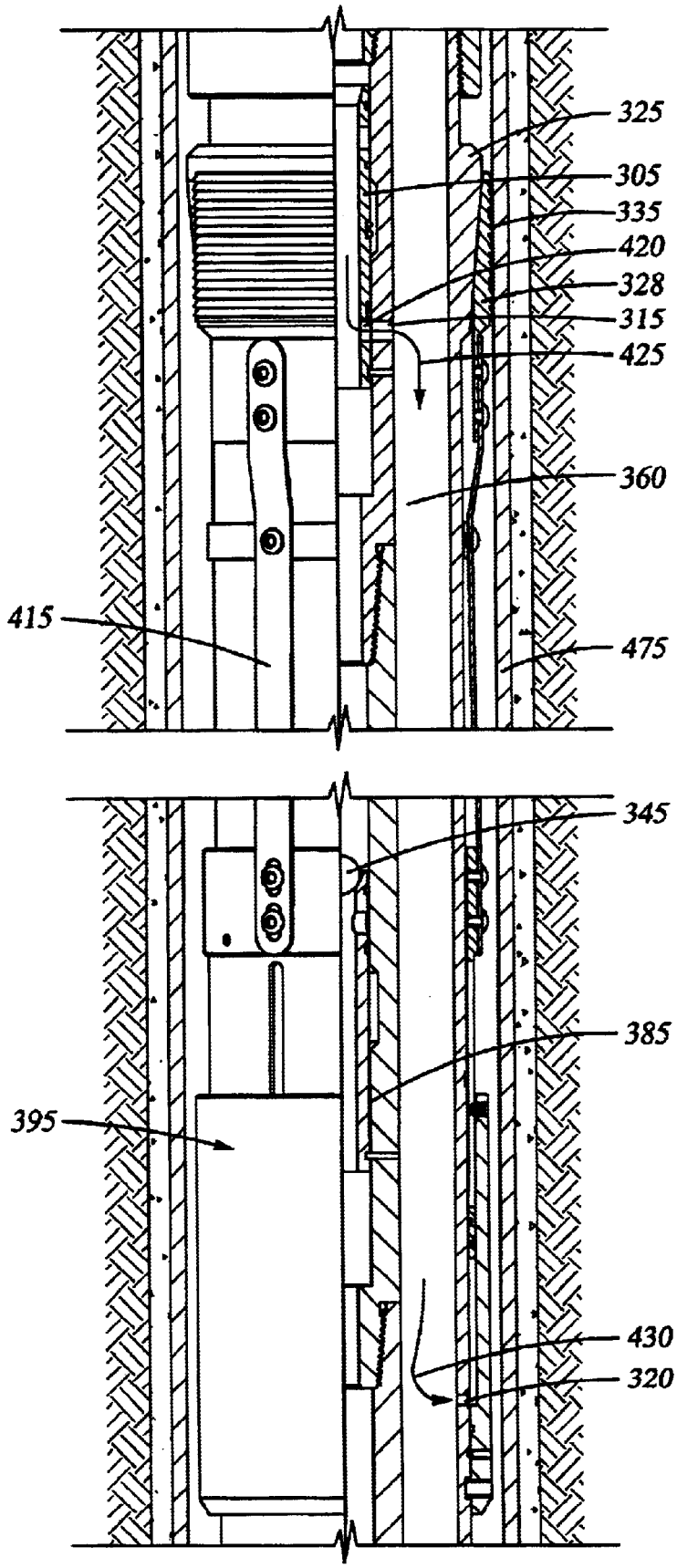
FIG. 6 illustrates the expansion tool assembly and liner assembly after slips have been set to fix the liner in the wellbore.

FIG. 6 illustrates the expansion tool assembly 100 and liner assembly 200 after the slips 328 have been set to fix the liner 200 in the wellbore. Ball 345 blocks fluid flow through the bore of the tool assembly 100, thereby redirecting the fluid flow to a first aperture 420 formed in the sleeve 305. The first aperture 420 is aligned with the first port 315 formed in a wall of the tool assembly 100 to form a fluid passageway to the annulus 360. A first arrow 425 illustrates the fluid flow into the annulus 360 and a second arrow 430 illustrates fluid flow from the annulus 360 through a second port 320. The fluid exiting the second port 320 acts on the piston 395, thereby urging the piston 395 upward in the direction of the cones 325. The longitudinal members 415 connecting the slips 328 to the piston 395 urges the slips 328 up the tapered portion of the cones 325, thereby expanding the slips 328 radially outward in contact with the casing 475. The teeth 335 formed on the outer surface of the slips 328 "bite" into the casing surface to hold the liner assembly 200 in position in the wellbore. FIG. 6 illustrates that the inner diameter of the assembly 200 is largely unobstructed by the set hanger and the bore is open to the passage of tools downhole.

Figure 7:
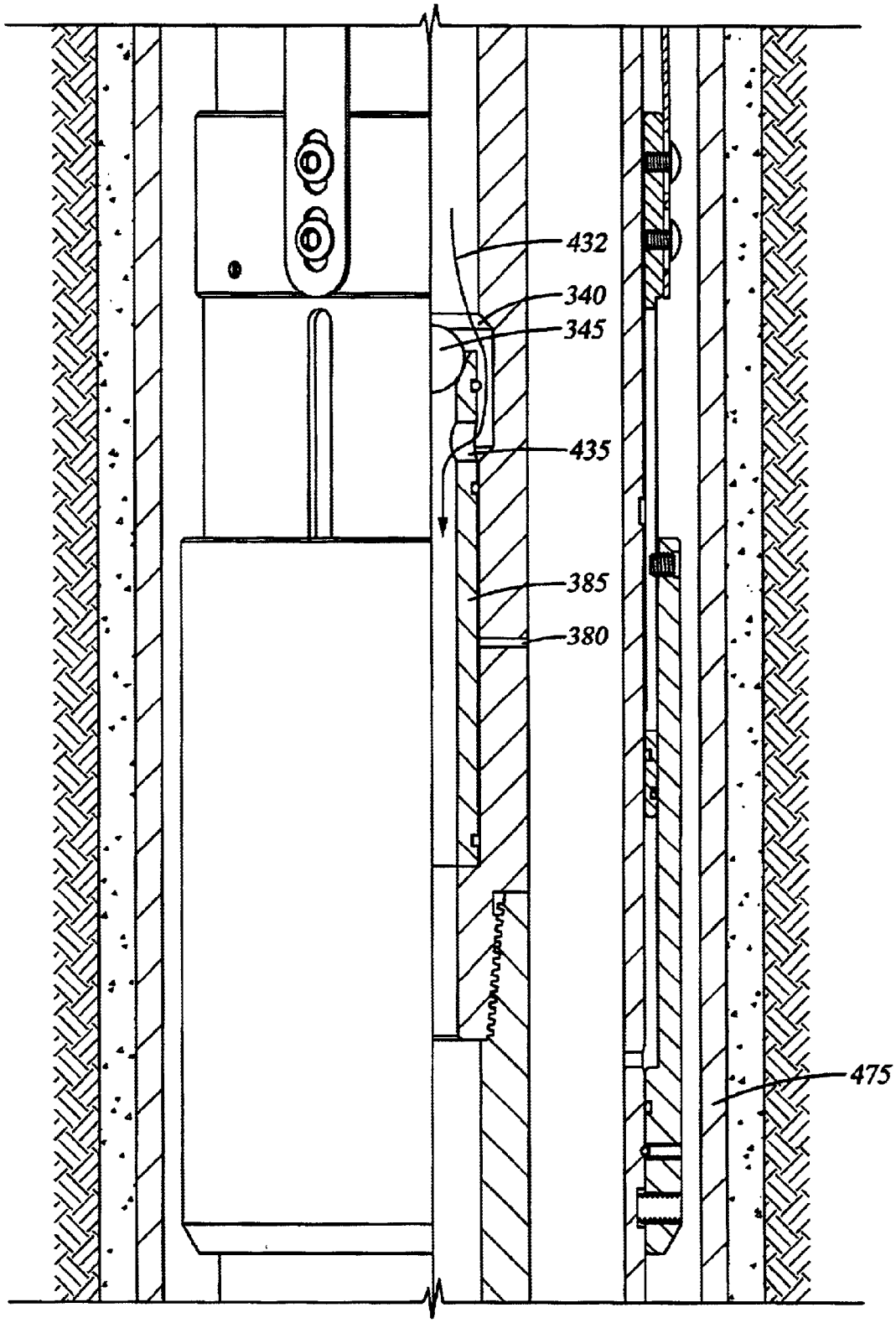
FIG. 7 illustrates the lower ball seat and sleeve shifted to a second position relative to the liner assembly to reestablish a fluid pathway through the bore of the tool assembly.

FIG. 7 illustrates the lower ball seat and sleeve 385 shifted to a second position relative to the liner assembly 200 to reestablish a fluid pathway through the bore of the tool assembly 100. After the liner assembly 200 is set in the casing 475, the fluid becomes pressurized acting against the first ball 345 which is housed in the lower ball seat and sleeve 385. At a predetermined pressure, pin 380 is sheared allowing the ball seat and sleeve 385 to shift downward to a second position. In the second position, a first by pass port 435 formed in the sleeve 385 aligns with the second circumferential groove 340 to reestablish a fluid pathway through the bore of the tool assembly 100 as illustrated by an arrow 432.

Figure 8:
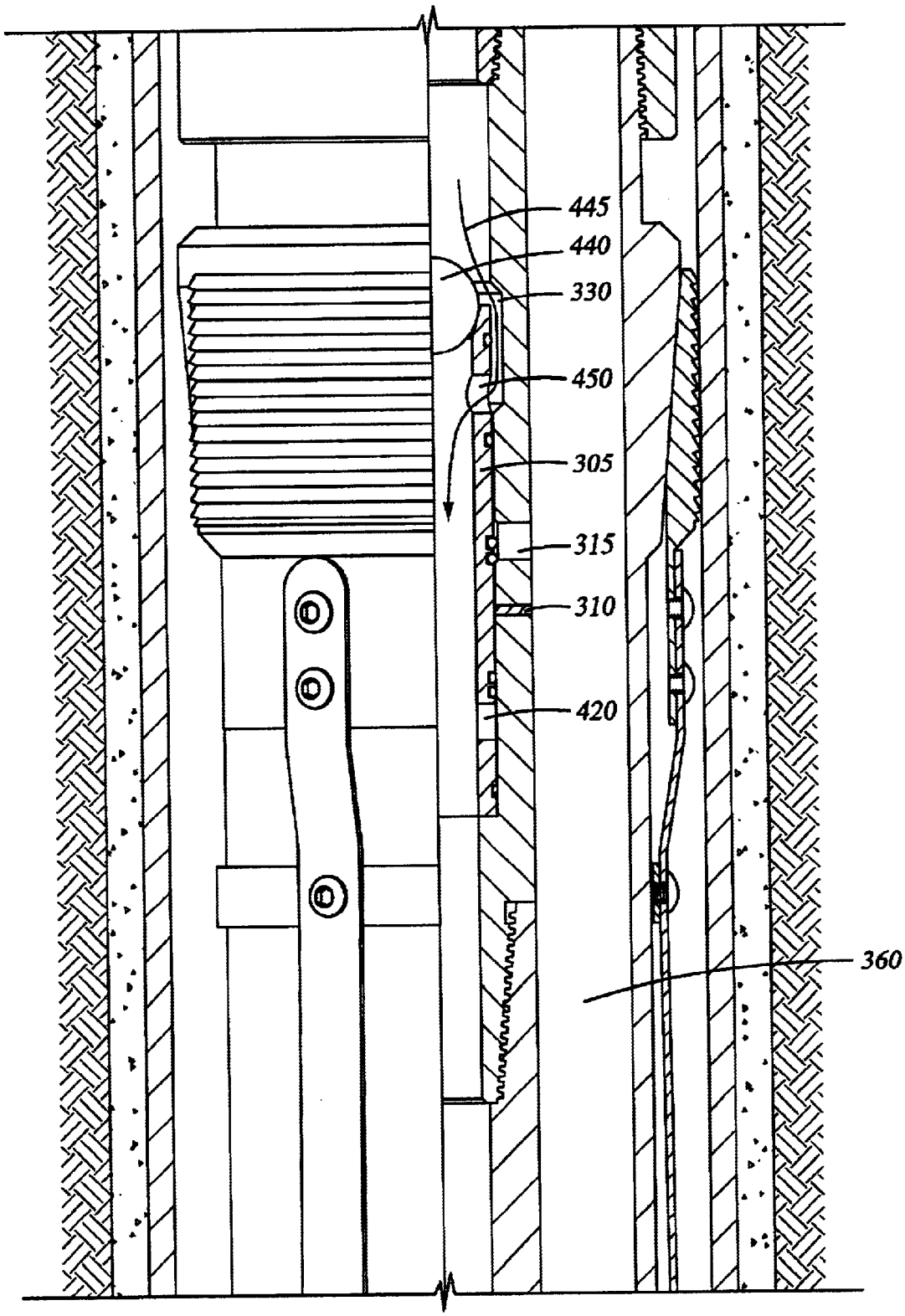
FIG. 8 illustrates an upper ball seat and sleeve in a second position relative to the liner assembly.

FIG. 8 illustrates the upper ball seat and sleeve 305 in a second position relative to the liner assembly 200 to establish a fluid pathway through the bore of the tool assembly 100. The flow path is established in order to provide a source of pressurized fluid to the expander tool 105 in order to expand the sand screen 215 at a lower end of the liner assembly 200. The second ball 440 is dropped into the tool assembly 100 and lands on an upper seat and sleeve 305 which is held in place by pin 310. Fluid thereafter becomes pressurized acting against the second ball 440. At a predetermined pressure the pin 310 is sheared allowing upper ball seat and sleeve 305 to shift downward to the second position. In the second position, the ball seat and sleeve 305 aligns a second bypass port 450 with the first circumferential groove 330 to provide a fluid passage way. The fluid flow down the bore of the assembly 100 bypasses the ball 440 as illustrated by arrow 445. In addition to reestablishing flow down the bore of the tool assembly 100, the seat and sleeve 305 also misaligns the first aperture 420 and the first port 315, thereby blocking fluid communication into middle annulus 360.

Figure 9:
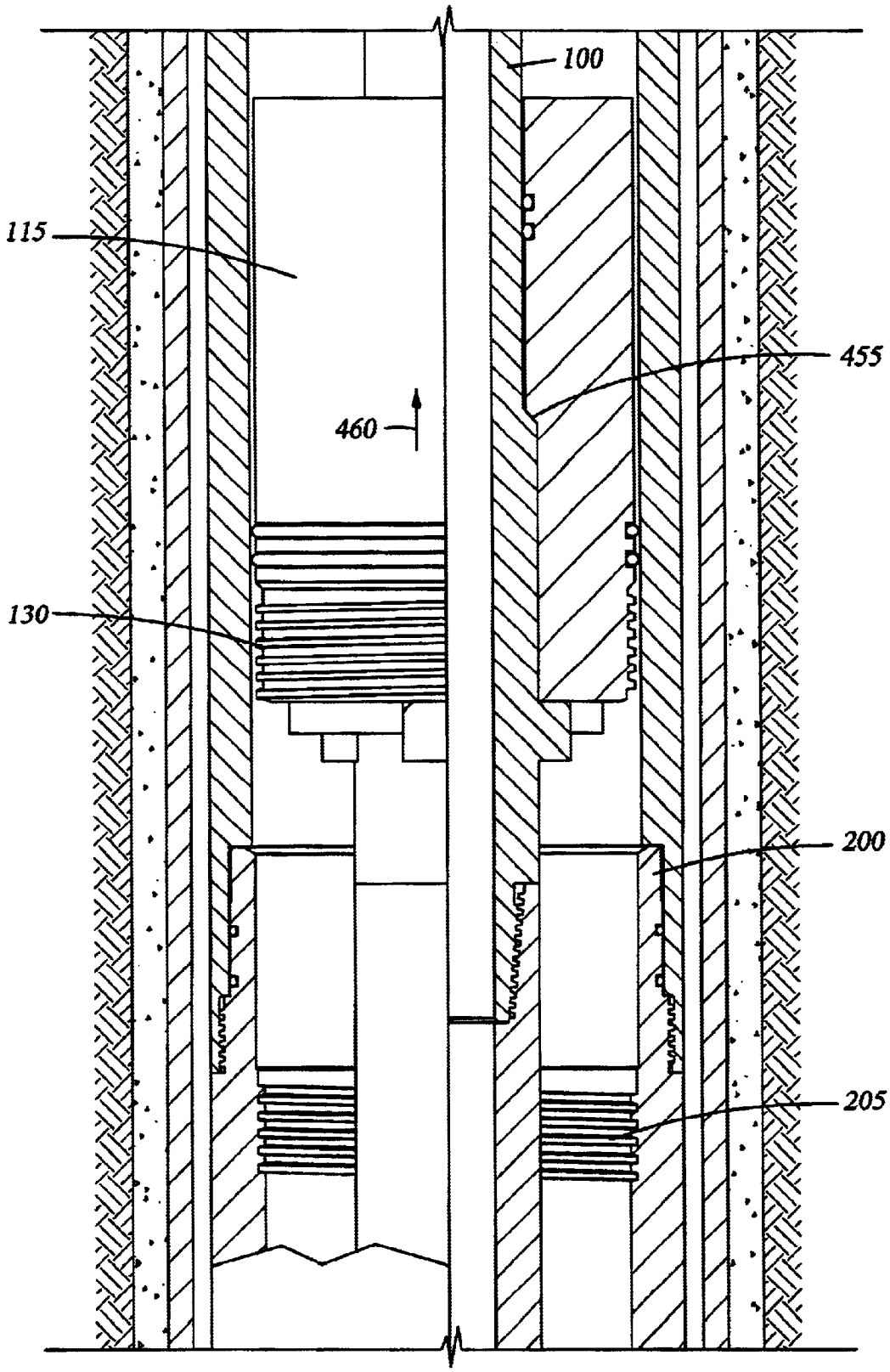
FIG. 9 illustrates an upward movement of the tool assembly in relation to the liner assembly.

FIG. 9 illustrates an upper movement of the tool assembly 100 in relation to the liner assembly 200. After the liner assembly 200 has been set in the wellbore, the expansion tool 100 with the carry nut 115 is rotated clockwise, thereby removing the male threads 130 on the carry nut 115 from the female threads 205 on the liner assembly 200. The tool assembly 100 is then lifted axially upward in relation to the liner assembly 200 as illustrated by a directional arrow 460. A shoulder 455 on the tool assembly 100 urges the carry nut 115 upward with the tool assembly 100 as the tool assembly 100 is partially lifted from the liner assembly 200.

Figure 10:
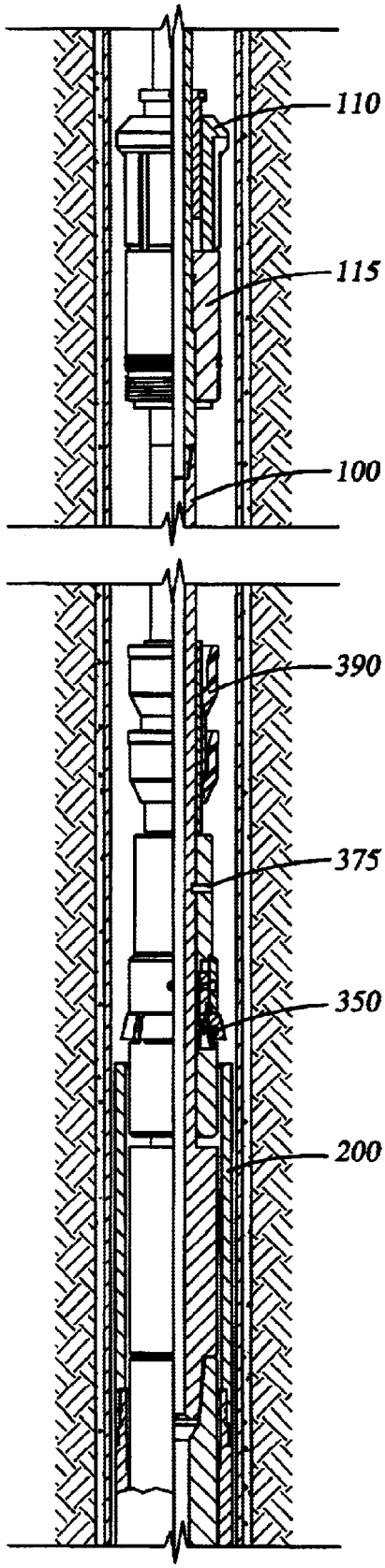
FIG. 10 illustrates the tool assembly lifted out of the liner assembly permitting dogs to clear the top of the liner assembly.

FIG. 10 illustrates the tool assembly 100 lifted out of the liner assembly 200 permitting dogs 350 to clear the top of the liner assembly 200. To prepare the tool assembly 100 to expand the screen 215, the expansion tool assembly 100 is partially pulled from the liner assembly 200 exposing the dust cover 110, carry nut 115, swab cups 390 and dogs 350. Upon removal from the liner assembly 200, the dogs 350 expand outward. Pin 375 holds the various components together.

Figure 11:
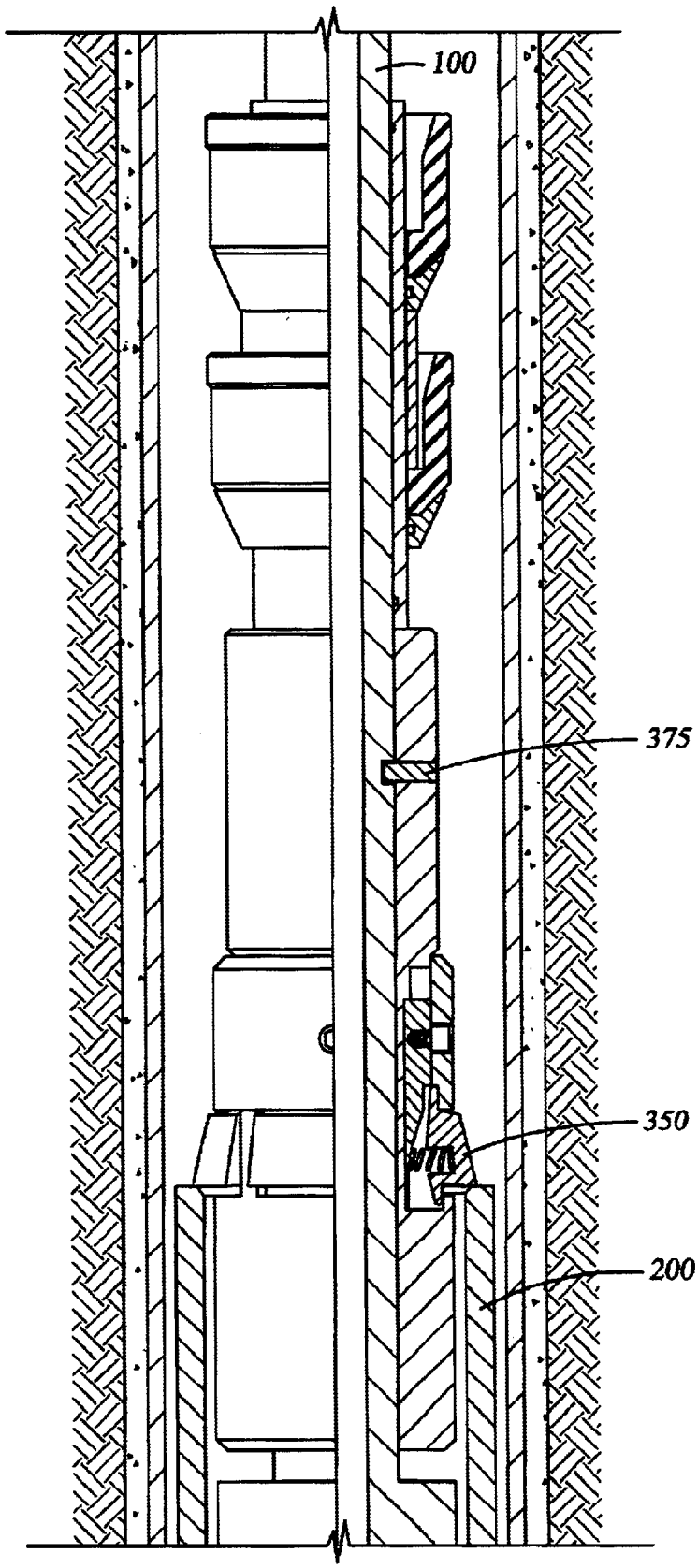
FIG. 11 is an enlarged view of FIG. 10, showing the expansion tool assembly suspended by dogs at the upper end of the liner assembly.

FIG. 11 is an enlarged view of FIG. 10, showing the expansion tool assembly 100 suspended by dogs 350 at the upper end of the liner assembly 200. After the tool assembly 100 is lifted from the liner assembly 200 and the dogs 350 expanded, it is then lowered until the expanded dogs 350 rest on top of the liner assembly 200. As shown, the dogs 350 are outwardly biased members that are constructed and arranged to ride along a tubular surface and then to extend outward when pulled out of contact with the tubular. With the components in position shown in FIG. 11, the expander tool 105 is ready to be lowered into the ESS 215.

Figure 12:
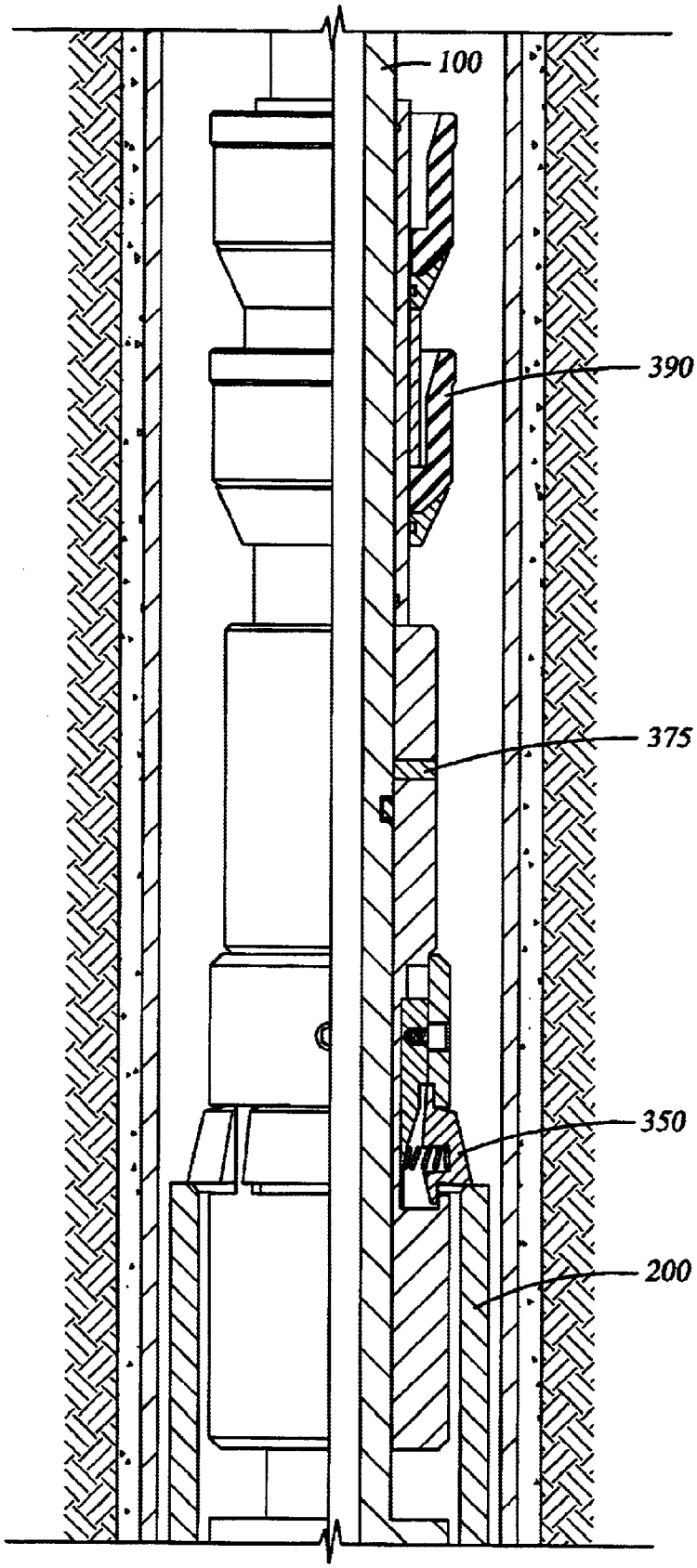
FIG. 12 illustrates downward movement of the expansion tool assembly in relation to the liner assembly and dogs in order to expand the ESS.

FIG. 12 illustrates downward movement of the expansion tool assembly 100 in relation to the liner assembly 200 and dogs 350 in order to expand the expandable sand screen 215. A downward force is placed the tool assembly 100, thereby exerting pressure on the pin 375. At a predetermined pressure, the pin 375 is sheared, thereby allowing the mud motor 120 and expander tool 105 along with the carrying tool 125 to drop down into the liner assembly 200 while the dust cover 110, the carry nut 115, the swab cups 390 and the dogs 350 remain above the top of the liner assembly 200. The tool assembly 100 is lowered until the expander tool 105 comes in contact with the ESS 215.

Figure 13:
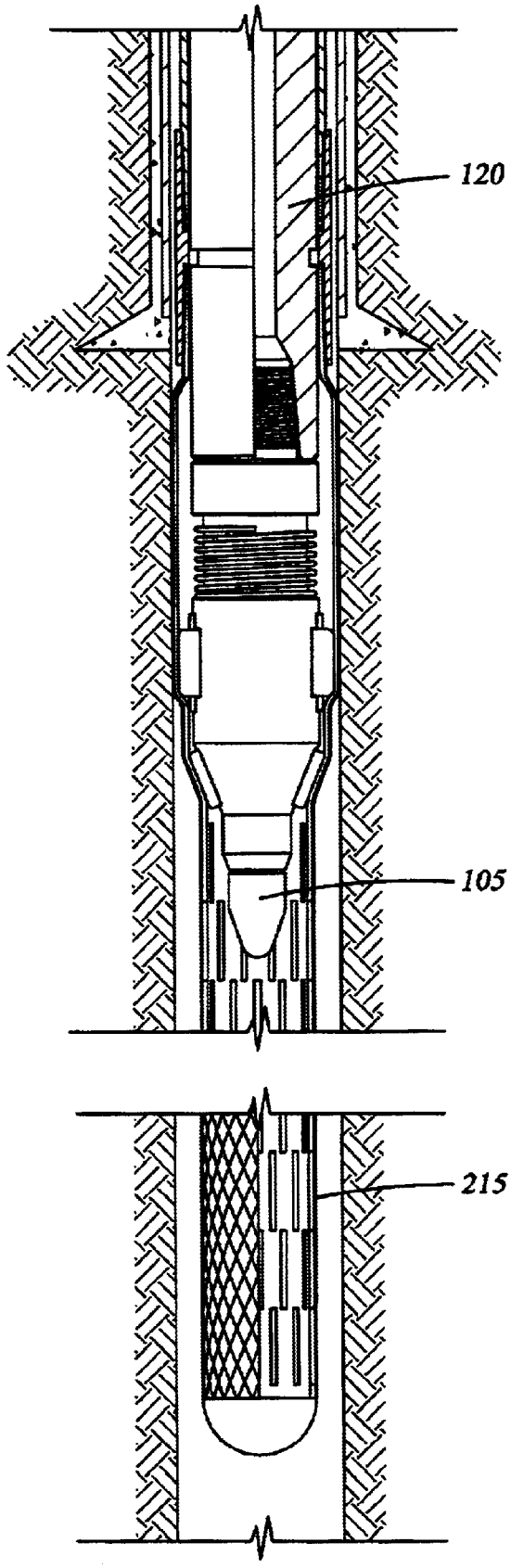
FIG. 13 illustrates the rotary expander tool expanding the sand screen.

FIG. 13 illustrates the rotary expander tool 105 expanding the sand screen 215. Fluid is pumped from the surface of the well down the bore of tool assembly 100 into the mud motor 120. The mud motor 120 provides rotational force to the expander tool 105 while causing radially extending rollers to extend outwards, thereby expanding the sand screen 215 into the borehole. FIG. 13 illustrates expanding a sand screen 215 in a vertical open hole. However, this invention is not limited to the one shown but rather can be used in many different completion scenarios such as casing that has been perforated.

Figure 14:
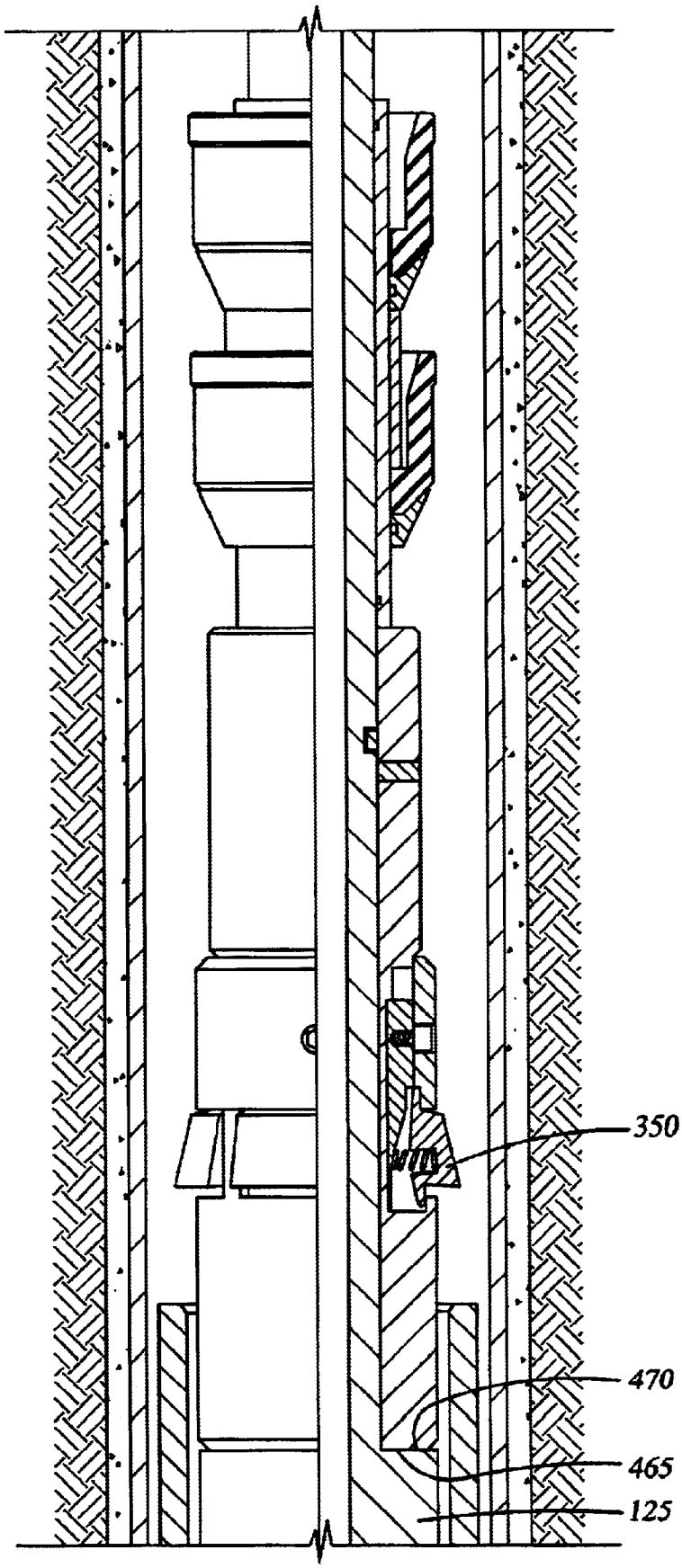
FIG. 14 illustrates the expansion tool assembly as it is removed from the liner assembly after the screen has been expanded.

FIG. 14 illustrates the expansion tool assembly 100 as it is removed from the liner assembly 200 after the ESS 215 has been expanded. As the tool assembly 100 is pulled upward, a top surface 470 of the carrying tool 125 contacts a bottom surface 465 of the dogs 350, thereby urging the dogs 350 off the top of the liner assembly 200. The entire tool assembly 100 is moved up out of the liner assembly 200 and then out of the wellbore. The ESS 215 allows hydrocarbons to enter the wellbore as it filters out sand and other particles. The expanded sand screen 215 is connected to production tubing at an upper end, thereby allowing the hydrocarbons travel to the surface of the well. In addition to filtering, the sand screen 215 preserves the integrity of the formation during production.

While the foregoing is directed to embodiments of the present invention, other and further embodiments of the invention may be devised without departing from the basic scope thereof, and the scope thereof is determined by the claims that follow.

What is claimed is:

1. A method of expanding a tubular in a wellbore, comprising:

running an apparatus into the wellbore, the apparatus including:

the tubular for expansion;

a slip for fixing the tubular in a wellbore;

an expander tool on a work string;

an attachment means between the work string and the tubular;

means for setting the slip including sealing members disposed around the work string and temporarily fixed thereto, to seal an annular area formed between the string and tubular;

setting the slip in the wellbore;

disengaging the attachment means;

lifting the work string and expansion tool with respect to the tubular, whereby the sealing members are removed from the tubular;

actuating the expander tool; and expanding at least a portion of the tubular through axial motion of the expansion tool and work string.

2. The method of claim 1, whereby lifting the work string and expansion tool includes lifting that portion of the work string and expansion tool including at least one dog member to a location above a top of the liner, thereby suspending the dogs at the liner top.

3. The method of claim 2, whereby the tubular includes a solid portion and a slotted portion.

4. The method of claim 3, wherein expanding the tubular through an axial motion includes shearing a member for fixing the sealing member and dogs to the work string.

5. The method of claim 1, further includes removing the expander tool and the work string from the tubular.

6. An apparatus for installing an expandable screen in a wellbore, the apparatus comprising:

an outer portion, the outer portion including:

a tubular liner and a tubular screen, the screen expandable with an outward radial force applied to its inner surface; and a slip, the slip energizable in the wellbore to axially and radially fix the outer portion to the wellbore, wherein the slip includes at least one discrete element thereon;

an inner portion coaxially disposed in the outer portion, the inner portion including:

a work string extending between a surface of the well and the apparatus;

an expander tool disposed at the end of the work string;

an attachment member for temporarily connecting the inner portion to the outer portion; and sealing members disposed around the inner portion to seal an annulus formed between the inner and outer portion.

7. The apparatus of claim 6, wherein the expander tool includes at least one radially extendable member.

8. A method for setting a liner and expanding a screen in a wellbore, comprising:

opening a fluid path from an interior of a first tubular to an annular area between the first tubular and an outer tubular;

setting a slip assembly with fluid via the fluid path to secure the outer tubular to the wellbore;

closing the fluid path; and expanding the screen.

9. The method of claim 8, wherein the fluid path is opened by dropping a ball into a ball seat, thereby blocking fluid flow through a bore of the apparatus.

10. The method of claim 9, wherein the fluid pathway is closed by shifting a sleeve to a second position.

11. A method for setting a liner and expanding a screen in a wellbore, comprising:

opening a fluid path from the interior of a first tubular to an annular area between the first tubular and an outer tubular;

setting a slip assembly with fluid via the fluid path;

closing the fluid path; and expanding the screen with an expander tool having at least one readily extendable member mounted thereupon.

12. A method of expanding a tubular in a wellbore, comprising:

positioning an apparatus in the wellbore, the apparatus having an expandable tubular and an expander tool on a work string disposed therein;

setting a slip disposed on the tubular, thereby securing the tubular in the wellbore;

disengaging an attachment means between the work string and the tubular;

lifting the work string and expansion tool with respect to the tubular, whereby a plurality of sealing members disposed on the work string are removed from an annulus defined between the work string and the tubular; and expanding at least a portion of the tubular through axial movement of the expansion tool and the work string relative to the tubular.

* * * * *